US010472811B2

(12) United States Patent
Carver et al.

(10) Patent No.: US 10,472,811 B2
(45) Date of Patent: Nov. 12, 2019

(54) IN-THE-BOWL DISPENSING DEVICE

(71) Applicant: Reckitt Benckiser (Brands) Limited, Slough, Berkshire (GB)

(72) Inventors: Kris Carver, Slough (GB); Jesse Delgigante, Slough (GB); Henry Fletcher, Cambridge (GB); John Kenneth Hainsworth, Cambridge (GB); Iain Christopher Smith, Cambridge (GB); Alim Thawer, Cambridge (GB)

(73) Assignee: RECKITT BENCKISER (BRANDS) LIMITED, Slough, Berkshire (GB)

( * ) Notice: Subject to any disclaimer, the term of this patent is extended or adjusted under 35 U.S.C. 154(b) by 0 days.

(21) Appl. No.: 16/072,444

(22) PCT Filed: Jan. 19, 2017

(86) PCT No.: PCT/GB2017/050132

§ 371 (c)(1),
(2) Date: Jul. 24, 2018

(87) PCT Pub. No.: WO2017/129948

PCT Pub. Date: Aug. 3, 2017

(65) Prior Publication Data

US 2019/0032318 A1 Jan. 31, 2019

Related U.S. Application Data

(60) Provisional application No. 62/286,692, filed on Jan. 25, 2016, provisional application No. 62/339,408, filed on May 20, 2016.

(51) Int. Cl.
*E03D 9/03* (2006.01)
*E03D 9/02* (2006.01)

(52) U.S. Cl.
CPC ..... *E03D 9/032* (2013.01); *E03D 2009/028* (2013.01)

(58) Field of Classification Search
CPC ..... E03D 9/03; E03D 9/031; E03D 9/032; E03D 9/033; E03D 9/035; E03D 9/036; E03D 9/037; E03D 9/038; E03D 2009/028
See application file for complete search history.

(56) References Cited

U.S. PATENT DOCUMENTS 3,999,226 A * 12/1976 Wolf ..... E03D 9/032 4/225.1
5,699,562 A * 12/1997 Lu ..... E03D 9/037 222/133

(Continued)

FOREIGN PATENT DOCUMENTS

EP 1072728 A2 1/2001
EP 1334239 A1 8/2003

(Continued)

OTHER PUBLICATIONS

International Search Report and Written Opinion of the International Searching Authority for corresponding application PCT/GB2017/050132 dated Jan. 19, 2017.

*Primary Examiner* — Janie M Loeppke
(74) *Attorney, Agent, or Firm* — Norris McLaughlin, PA

(57) ABSTRACT

Disclosed is an in-the-bowl dispensing device designed to dispense two liquid compositions into a toilet bowl at two separate time intervals. One dispensing action takes place during the flush of the toilet bowl and a second separate dispensing action takes place after the flush of the toilet bowl is complete. In this manner the second liquid composition is retained in the toilet bowl until the toilet bowl is flushed by the next user.

12 Claims, 11 Drawing Sheets

(56) References Cited

U.S. PATENT DOCUMENTS

| | | | | |
|---|---|---|---|---|
| 2004/0068782 | A1* | 4/2004 | Butter-Jentsch | C11D 3/3956 4/231 |
| 2004/0221378 | A1* | 11/2004 | Conway | E03D 9/032 4/231 |
| 2006/0005308 | A1* | 1/2006 | Pagani | E03D 9/032 4/231 |
| 2006/0123528 | A1* | 6/2006 | Pagani | E03D 9/032 4/231 |
| 2008/0307571 | A1* | 12/2008 | Slade | E03D 9/032 4/223 |
| 2009/0077727 | A1* | 3/2009 | Virica | E03D 9/032 4/227.1 |
| 2010/0205732 | A1* | 8/2010 | Muhlhausen | E03D 9/005 4/226.1 |
| 2012/0073036 | A1* | 3/2012 | Rizzo | E03D 9/037 4/231 |

FOREIGN PATENT DOCUMENTS

| | | | |
|---|---|---|---|
| EP | 1334239 | B1 | 1/2006 |
| EP | 1978168 | A1 | 10/2008 |
| WO | 0104428 | A1 | 1/2001 |
| WO | 0240790 | A1 | 5/2002 |

* cited by examiner

IN-THE-BOWL DISPENSING DEVICE

This is an application filed under 35 USC 371 based on PCT/GB2017/050132 filed 19 Jan. 2017, which in turn is based on U.S. Ser. No. 62/286692 filed 25 Jan. 2016 and U.S. Ser. No. 62/339408 filed 20 May 2016. The present application claims all available priority benefit of these prior applications and herein incorporates by reference the full disclosures of these prior applications.

BACKGROUND OF THE INVENTION

The invention provides an in-the-bowl dispensing device (ITB) for use with a toilet.

The ITB of the invention is a dual chamber, liquid ITB designed to dispense two liquid compositions into a toilet bowl at two separate time intervals. A first liquid composition is dispensed at the start of or during the flush of a toilet bowl and a second liquid composition is dispensed near or at the end of the flush of the toilet bowl. In this manner a first liquid composition will reside in the toilet bowl during flushing to provide, for example, a cleaning benefit to the toilet while a second liquid composition will remain in the toilet bowl after flushing is complete to provide, for example, a fragrancing and malodor reduction or elimination benefit.

SUMMARY OF THE PREFERRED EMBODIMENT OF THE INVENTION

When a person enters a bathroom to use a toilet bowl, they prefer two things. First, that the toilet bowl is clean and, second, that the air in the bathroom is devoid of malodor. Such can be problematic particularly where a prior user of the bathroom has defecated into the toilet bowl, even though the prior user has flushed the toilet bowl after use. The ITB of the present invention provides a solution to this problem.

When a toilet bowl is flushed after use, in a preferred embodiment of the present invention, a liquid cleaning composition is released from the ITB into the flush water. This cleaning composition, in combination with the action of the flush water, provides a cleaning benefit to the toilet bowl. After the flushing operation has ceased or is nearly completed, the present invention releases a second liquid composition to the bowl. In a preferred embodiment, this second liquid composition in part comprises fragranced essential oils that float on top of the surface of the water remaining in the bowl. In this manner a fragrancing benefit is provided to the toilet bowl and a barrier is created on the water surface.

When a subsequent user defecates into the toilet bowl, malodors associated with the feces are trapped beneath the essential oil barrier thus eliminating or reducing the amount of malodor emitted from the feces into the air within the bathroom. Additionally, more fragrance is released into the air by virtue of the turbulence created within the toilet bowl water. In this manner, in a preferred embodiment, the ITB of the present invention in addition to a cleaning benefit, also provides a malodor elimination or reduction and fragrancing benefit.

The ITB of the present invention is able to provide such a dual benefit by means of the use of a container (e.g., a bottle) of a liquid cleaning composition and a bottle of a liquid fragrancing composition. In the preferred embodiment, the bottle of the cleaning composition and the bottle of the fragrancing composition are inverted. By "inverted" it is meant that the bottle opening is in a downward position facing in the general direction of the bottom of the toilet bowl. Both bottles are removably attached to a supporting cage which in turn is hung from the rim of the toilet bowl by a suspension means, for example, a hook, so as to be in the path of the flushing water. Upon insertion of the bottles into the cage, the closures covering the mouths of the bottles are opened by a piercing structure or other means for opening the bottles. The contents of the inverted bottles are thus exposed to atmospheric pressure while retained in the supporting cage and can flow out of the inverted bottles through liquid flow chambers which comprise a portion of the piercing structure.

Associated with the supporting cage is a lever arm which is able to rotate around a pivot point which is also associated with and a part of the supporting cage. The lever arm is optionally, but preferably, equipped at one end with a receptacle for temporarily capturing and retaining a portion of the flush water during a toilet flushing operation. The receptacle has one or more drainage holes for releasing back into the toilet bowl, over a period of time that exceeds the time for a flushing operation of the toilet bowl to be completed, all or a majority of that portion of the flush water temporarily captured by the receptacle. Also associated with the lever arm are two displacement elements which may be, for example, in the form of a cup. These two displacement elements are hereinafter referred to as "dosing cups". One dosing cup is in fluid communication with the bottle of cleaning composition and the second dosing cup is in fluid communication with the bottle of fragrancing composition.

In contact with the lever arm and abutting the supporting cage is a biasing element, such as a spring, which biases the lever arm in a position around the pivot point such that the dosing cups can move in an upward and downward position in relation to the liquid flow chambers of their respective bottles of cleaning and fragrancing composition.

The operation of the preferred embodiment of the ITB of the present in invention is hereinafter described.

In its initial or pre-flush position, no liquid is dispensed from the ITB into the toilet bowl. The lever arm is biased by the spring into a position which is approximately horizontal. The first dosing cup surrounds a portion of the liquid flow chamber associated with the bottle containing the cleaning composition. When the closure of the bottle of cleaning composition is pierced, the first dosing cup partially fills with the cleaning composition to a level where equilibrium is reached between the contents of the bottle of cleaning composition and the atmospheric pressure on the liquid retained in the dosing cup. Factors affecting this equilibrium include gravity, the surface tension and viscosity of the cleaning composition, the geometry of the liquid flow chamber and the geometry of the first dosing cup. These factors are all considered so that the level of cleaning composition in the first dosing cup is below the top of the first dosing cup. That is, there is no discharge or overflow from the first dosing cup in this initial pre-flush position.

When the closure of the bottle of fragrancing composition is pierced, the second dosing cup partially fills with the fragrancing composition to a level where equilibrium is reached between the contents of the bottle of fragrancing composition and the atmospheric pressure on the liquid retained in the second dosing cup. Factors affecting this equilibrium similarly include gravity, the surface tension and viscosity of the fragrancing composition, the geometry of the liquid flow chamber and the geometry of the second dosing cup. These factors are all considered so that the level of fragrancing composition in the second dosing cup is below the top of the second dosing cup. There is no discharge or overflow from the second dosing cup in this initial pre-flush position.

In the second or flushing position, when a user flushes the toilet, a portion of the flush water contacts a deflector ramp. The deflector ramp is preferably a part of the lever arm, but it may instead be associated with the supporting cage. The deflector ramp directs a portion of the flush water to the receptacle at one end of the lever arm. This portion of the flush water is temporarily retained in the receptacle. The weight of the retained flush water biases the lever arm partially around the pivot point, against the force of the spring, such that the receptacle moves in a downwards direction toward the bottom of the toilet bowl. This movement or tilting of the lever arm moves the first dosing cup, which resides on the lever arm on the opposite side of the pivot point from the receptacle, in a direction upwards towards the opening of the liquid flow chamber associated with the bottle containing the cleaning composition. As the first dosing cup is moved upwards in this manner, a greater portion (i.e. volume) of the liquid flow chamber is immersed in the first dosing cup. As a result, a volume of the cleaning composition is displaced from the first dosing cup via a drip point on the first dosing cup into the flush water in the toilet bowl where it provides a cleaning benefit. Displacement from the first dosing cup in this manner is attributable to the Archimedes Principle as such will be understood by one skilled in the art. This movement of the lever arm at the same time moves the second dosing cup downward and away from the liquid flow chamber associated with the bottle containing the fragrancing composition. By moving in this position, the available volume in the second dosing cup is increased and fluid communication between the second dosing cup and the liquid flow chamber for the fragrancing composition is temporarily disrupted. Air is thus permitted to enter the bottle containing the fragrancing composition and, as a result, an additional volume of fragrancing composition can flow downward through the liquid flow chamber and into the second dosing cup. This continues until equilibrium between the contents of the bottle of fragrancing composition and the level of fragrancing composition in the second dosing cup is reached. There is no discharge from the second dosing cup.

The drainage hole(s) in the receptacle is specifically sized such that when all or nearly all of the flush water temporarily captured by the receptacle has been released back to the toilet bowl, the flushing operation of the bowl has been or is near completion. With the weight of the captured flush water thus diminished or removed from the lever arm, in the third or post-flush position, the lever arm is biased by the spring around the pivot point in a manner such that that the first dosing cup is moved downward back to its initial pre-flush. Due to this movement, the available volume in the first dosing cup is increased and fluid communication between the first dosing cup and the liquid flow chamber for the cleaning position is temporarily disrupted. Air is thus permitted to enter the bottle containing the cleaning composition and, as a result, the cleaning composition can flow downward through the liquid flow chamber and into the first dosing cup until equilibrium between the contents of the bottle of cleaning composition and the level of cleaning composition in the first dosing cup is reached. In this manner the first dosing cup is re-filled with the cleaning composition. There is no discharge from the first dosing cup during this re-filling operation. Simultaneously, the second dosing cup filled with the fragrancing composition is moved upwards toward the opening of the liquid flow chamber associated with the bottle containing the fragrancing composition. As the second dosing cup is moved upwards in this manner, a volume of the fragrancing composition is displaced from the second dosing cup via a drip point on the second dosing cup. This displacement is again attributable to the Archimedes Principle. Due to its essential oil characteristics and the fact that the flushing operation of the toilet bowl has or nearly has ceased, the displaced fragrance composition (a microemulsion) is able to provide a fragrancing benefit to the toilet bowl and spread across the top of the water remaining in the toilet bowl to create a barrier against malodor emanating from the toilet bowl upon subsequent use of the toilet bowl by a user. In this manner a malodor reduction and fragrancing benefit is provided.

A more detailed description of preferred embodiment of the invention in addition to alternative embodiments of the invention follows in conjunction with the drawings.

BRIEF DESCRIPTION OF THE FIGURES

An exemplary embodiment of the present invention will now be described with reference to the drawings in which.

DETAILED DESCRIPTION OF THE INVENTION

Figure 1:
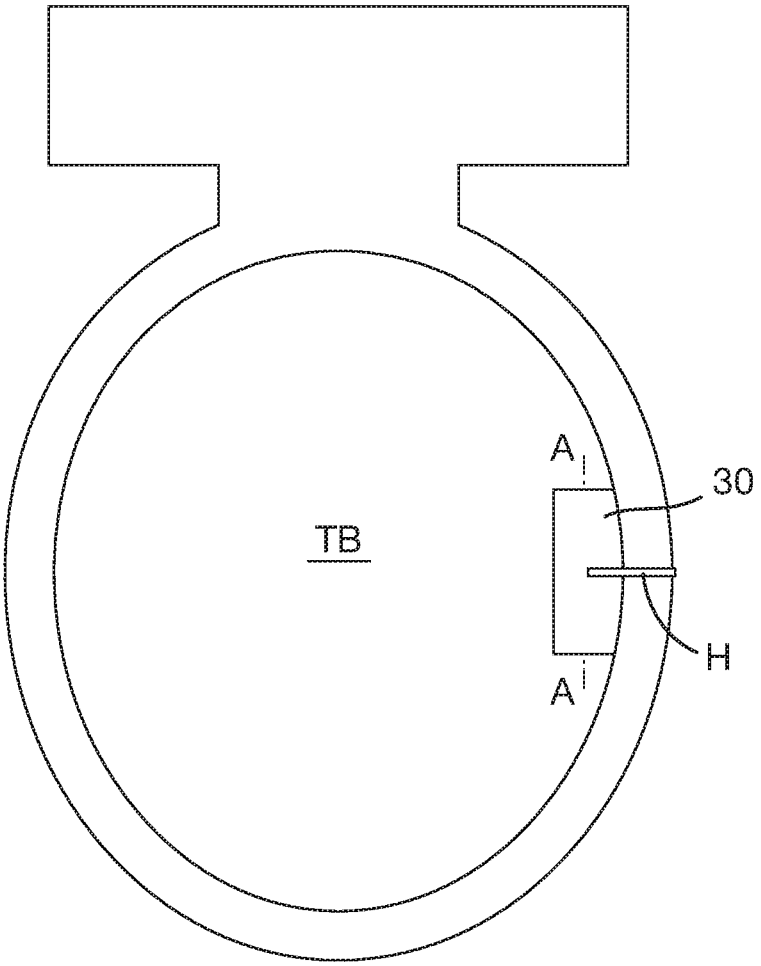
FIG. 1 depicts a top plan view of the ITB of the invention suspended inside of a toilet bowl.

To facilitate an understanding of the principles and features of the various embodiments of the present invention, various illustrative embodiments are explained herein. Although exemplary embodiments of the present invention are explained in detail, it is to be understood that other embodiments are contemplated. Accordingly, it is not intended that the present invention is limited in scope to the details of construction and arrangement of components set forth in the description, figures or examples. The present invention is capable of other embodiments and of being practiced or carried out in various ways.

As used in the specification and the appended claims, the singular forms of "a", "an" and "the" include plural references unless the context clearly dictates otherwise. For example, reference to a component is intended also to include a composition of a plurality of components. References to a composition containing "a" constituent is intended to include other constituents in addition to the one named.

In describing the exemplary embodiments, terminology will be resorted to for the sake of clarity. It is intended that each term contemplates its broadest meaning as understood by those skilled in the art and includes all technical equivalents that operate in a similar manner to accomplish a similar purpose.

With respect to the components of the ITB, ranges may be expressed herein as from "about" or "approximately" or "substantially" one orientation and/or to "about" or "approximately" or "substantially" another particular orientation. When such a range is expressed, other exemplary embodiments include from the one particular orientation and/or to the other particular orientation.

The terms "first", "second", "third" and the like in the description and in the claims are used for distinguishing between similar elements and not necessarily for describing a sequential or chronological order. It is to be understood that the terms so used are interchangeable under appropriate circumstances.

In the following claims the terms "comprising", "containing", and "including" are open-ended. That is, a device, composition, formulation, method or process that includes elements in addition to those listed after such a term are still deemed to fall within the scope of that claim. Stated differently, the mention of one or method steps does not preclude the presence of additional method steps or intervening method steps between those steps expressly identified. Similarly, the mention of one or more components in a composition or a device does not preclude the presence of additional components than those expressly identified.

The materials described as making up the various elements of the present invention are intended to be illustrative and not restrictive. Many suitable materials that would perform the same or a similar function as the materials described herein are intended to be embraced within the scope of the present invention.

Displacement Method

According to a first aspect (the "displacement method") of the invention there is provided a dispensing device for using a flow of water during a toilet flush to dispense two liquid compositions into a toilet bowl at two separate time intervals, the device comprising:

a first bottle for holding a first composition, the first bottle having a mouth and a closure for covering the mouth;

a second bottle for holding a second composition, the second bottle having a mouth and a closure for covering the mouth;

a supporting cage for holding the first and second bottles in an inverted position, the supporting cage having piercing structures and liquid flow chambers suitable for opening the closures of the first and second bottles and conveying the first composition to a first dosing cup and the second composition to a second dosing cup;

a lever arm pivotably connected to the supporting cage by a pivot point; the lever arm comprising:

the first dosing cup and the second dosing cup, the first and second dosing cups being disposed on the lever arm on opposite sides of the pivot point; and optionally, but preferably, a receptacle for temporarily retaining a portion of the flow of water during a toilet flush;

a biasing means in contact with the lever arm and the supporting cage;

a suspension means for suspending the supporting cage from a rim of the toilet bowl to position the supporting cage within the flow of water during a toilet flush such that at least a portion of the flow of water is directed into the receptacle during a toilet flush;

wherein at the start of or during the toilet flush, the water retained in the receptacle causes the lever arm to rotate from its initial position about the pivot point and cause the first composition to be dispensed from the first dosing cup into the toilet bowl; and near or at the end of the toilet flush, the lever arm is biased about the pivot point by the biasing means to its initial position and cause the second composition to be dispensed from the second dosing cup into the toilet bowl, such that the second composition remains in the toilet bowl after the toilet flush is complete.

The displacement method hereinafter described uses the well-known physical phenomenon that atmospheric pressure acting on a surface area of a pool of liquid can support a column of liquid within an inverted vessel or container (such as a bottle) whose open end is submerged in the pool of liquid. The volume of the pool of liquid which is accumulated in the dosing cup is dependent on its height which in turn is dependent on a number of factors including the annular surface area of the pool, the viscosity of the liquid composition, its surface tension, and others. The ITB of the present invention can be readily adapted for use with a wide variety of liquid compositions having a viscosity within the range of 1 to 4,000 centipoises, more preferably 1 to 400 centipoises, and most preferably 1 to 40 centipoises at 25° C. to meet different criteria in terms of color, foam forming, odor release, desired number of flushing operations per bottle, and other considerations.

The ITB of the present invention (30) is intended to be positioned in a toilet bowl (TB) by means of a hook (H) or other suspension means. See, for example, FIG. 1.

Figure 2:
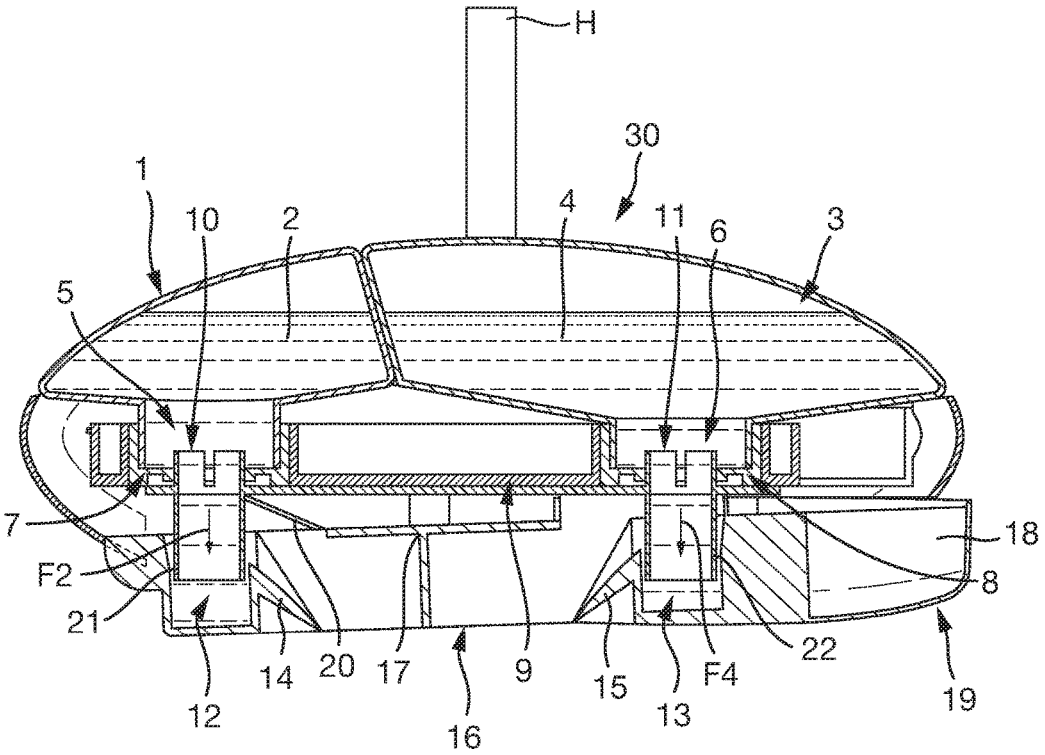
FIG. 2 is a cross-sectional view, taken along line A-A of FIG. 1, of the preferred embodiment of the ITB of the invention in its initial pre-flush position.

The ITB of the present invention (such as depicted in FIG. 2) preferably comprises two separate containers or bottles (1, 3), although a single dual chamber bottle may also be used. Two separate bottles are preferred so if one bottle is depleted before the other, the consumer will not need to discard the bottle of unused composition when returning the ITB of the invention to its intended operation. In a preferred embodiment, one bottle (1) contains a cleaning composition (2) and the second bottle (3) contains a fragrance composition (4). In other embodiments other or additional compositions can be used such as, but not limited to, those containing bleach, hydrogen peroxide, quaternary ammonium compounds and other actives effective against microorganisms typically found in a toilet bowl environment. Both bottles (1, 3) are preferably constructed of a clear plastic material compatible with the chemistry of their respective cleaning (2) and fragrancing (4) compositions. It is preferred that the bottles (1, 3) are clear so that a consumer can easily view when their contents are empty and require replacement. The plastic is preferably polyethylene terephthalate (PET).

Each bottle (1, 3) has a mouth (5, 6) and a bottle closure (7, 8) enclosing the bottles to retain the cleaning composition (2) and the fragrance composition (4), respectively. The bottles (1, 3) are inverted with their mouths (5, 6) facing the bottom of the toilet bowl (TB) and inserted by a user into a supporting cage (9). Associated with the supporting cage (9) are two piercing structures (10, 11) and liquid flow chambers (21, 22). As the user applies force to the bottles (1, 3) to insert them into the supporting cage (9), the bottle closure (7) covering the mouth (5) of the bottle (1) containing the cleaning composition (2) is aligned with and breached by piercing structure (10). With the bottle (1) of cleaning composition (2) thus open to atmospheric pressure, the cleaning composition (2) due to its surface tension and gravity is able to flow downward (as depicted by arrow F2 in FIG. 2) through liquid flow chamber (21) and partially fill a dosing cup (12) until equilibrium between the contents of the bottle (1) and the atmospheric pressure on the liquid in the dosing cup (12) is reached. In this position the exit from liquid flow chamber (21) is within the confines of dosing cup (12). The level of cleaning composition (2) within dosing cup (12) is above the exit from liquid flow chamber (21). That is, the exit from liquid flow chamber (21) is submerged beneath the level of cleaning composition (2) within dosing cup (12). The cleaning composition (2) does not overflow the dosing cup (12) and there is no discharge of the cleaning composition (2) from the dosing cup (12) in this initial or pre-flush position.

In a similar manner, as the user applies force to the bottle (3) containing the fragrance composition (4), the bottle closure (8) covering the mouth (6) of the bottle (3) is breached by a second piercing structure (11). With the bottle (3) of fragrance composition (4) thus open to atmospheric pressure, the fragrance composition (4) due to its surface tension and gravity is able to flow downward (as depicted by arrow F4) through liquid flow chamber (22) and partially fill a second dosing cup (13) until equilibrium is reached between the contents of the bottle (3) and the atmospheric pressure on the liquid in the dosing cup (13). In this position the exit from liquid flow chamber (22) is within the confines of dosing cup (13). The level of fragrancing composition (4) within dosing cup (13) is above the exit from liquid flow chamber (22). That is, the exit from liquid flow chamber (22) is submerged beneath the level of fragrancing composition (4) within dosing cup (13). The fragrance composition (4) does not overflow the dosing cup (13) and there is no discharge of the fragrance composition (4) in this initial or pre-flush position.

The first dosing cup (12) remains in fluid communication with the cleaning composition (2) in its associated bottle (1) and the second dosing cup (13) remains in fluid communication with the fragrance composition (4) in its associated bottle (3). Both the first dosing cup (12) and the second dosing cup (13) are constructed so as to include drip points (14, 15) whose purpose will later be described.

Figure 3:
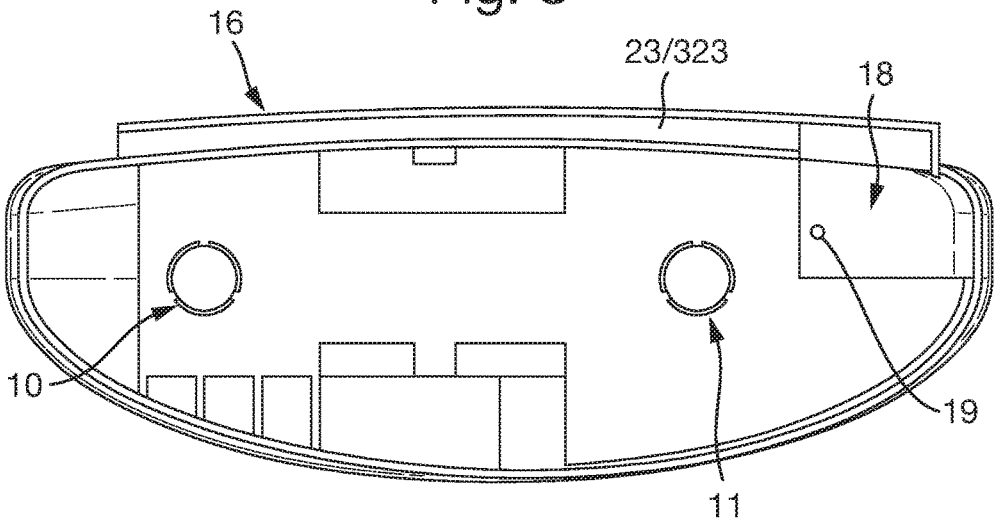
FIG. 3 is a top plan view of the ITB of the invention.
Figure 4:
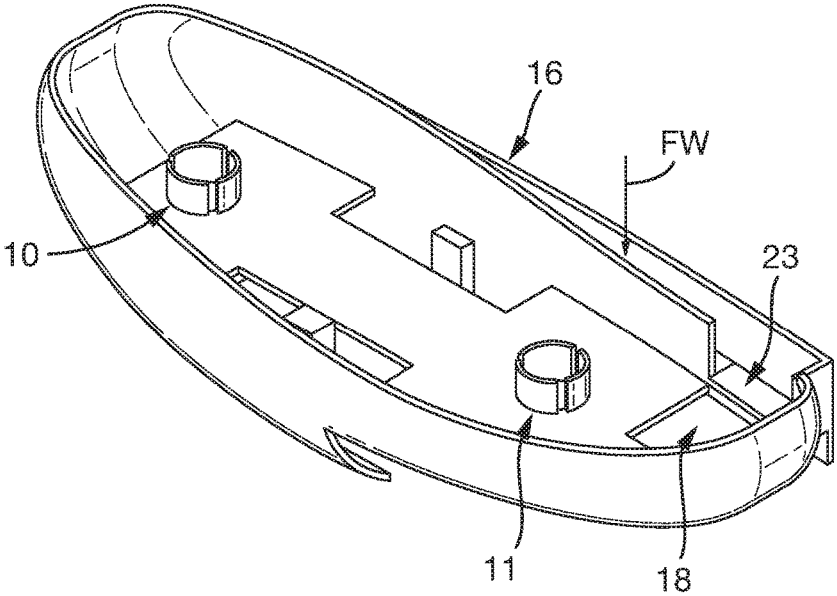
FIG. 4 is a top perspective view of the supporting cage and deflector ramp.

The first dosing cup (12) and the second dosing cup (13), hereinafter for the sake of clarity referred to respectively as the cleaning composition dosing cup (12) and the fragrance composition dosing cup (13), are disposed on a lever arm (16) which is attached to the supporting cage (9) by means of a pivot point (17). The lever arm (16) is able to be pivoted around the pivot point (17). The cleaning composition dosing cup (12) and the fragrance composition dosing cup (13) are disposed on opposite sides of the pivot point (17). The lever arm (16) is constructed to include an inclined deflector ramp (23) (See FIGS. 3 and 4). When the ITB is properly positioned inside of a toilet bowl, the deflector ramp (23) abuts or is in close proximity to a wall of the toilet bowl. Further disposed on the lever arm (16) is a receptacle (18) at an end of and in fluid communication with the deflector ramp (23). The receptacle (18) is proximate to and on the same side of the pivot point (17) as the fragrance composition dosing cup (13). The receptacle (18) contains at its lowermost point one or more drainage holes (19). Disposed between and in contact with the lever arm (16) and the supporting cage (9) is a biasing means such as a spring (20). The spring (20) is proximate to and on the same side of the pivot point (17) as the cleaning composition dosing cup (12). The spring (20) is designed so as to initially orient the lever arm (16) in a position such that the bottom of the cleaning composition dosing cup (12) is further removed from the exit of liquid flow chamber (21) than the bottom of the fragrance composition dosing cup is from the exit of liquid flow chamber (22). In this orientation of the lever arm (16), the cleaning composition dosing cup (12) is partially filled with cleaning composition (2) and the fragrance composition dosing cup (13) is partially filled with fragrance composition (4). See FIG. 2.

While the invention is not limited in scope as to the ingredients or weight percentages of the cleaning composition or the fragrance composition, Table 1 and Table 2, below, exemplify such compositions which can be used with the ITB of the present invention:

TABLE 1

Cleaning Composition

| Ingredient | Weight percentage (w/w %) | Trade Name | Function |
|---|---|---|---|
| Deionized water | 50-70 | — | Solvent |
| Alkyl Ether Sulfate C10-C16 Sodium Salt | 10-20 | Texapon N70NA | Anionic surfactant |
| Propylene glycol | 5-15 | | Anti-drying |
| Alcohols, C9-C11, ethoxylated | 2-10 | Tomadol 91-8 | Non-ionic Surfactant |
| Alkyl polyglycoside, C8-C16 | 1-10 | Glucopon 325N | Non-ionic Surfactant |
| Sodium citrate dihydrate | 0.1-1.0 | — | pH buffer |
| Preservative | 0.05-0.15 | — | Preservative |
| Dye | 0.001-0.010 | — | Color |
| TOTAL | 100 | | |

Viscosity=15 cp (as measured at room temperature by Brookfield DV11 viscometer, spindle 2, 60 rpm).

TABLE 2

Fragrance Composition

| Ingredient | Weight percentage (w/w %) |
|---|---|
| Deionized water | 80-85 |
| Nonionic surfactant/emulsifier (Polysorbate 80) | 2-10 |
| Fragrance | 10-15 |
| TOTAL | 100 |

Surface tension=32 dynes/cm

Viscosity=5 cp (as measured at room temperature by a Brookfield DV11 viscometer, spindle 2, 60 rpm)

The invention is also not limited in scope to the materials of construction of the various components of the invention. However, other than the bottles containing the cleaning composition and the fragrance composition (which are preferably PET) it is preferred that such components be constructed of a plastic such as polyethylene.

Displacement Method Use

According to a second aspect of the invention there is provided a method of use of an in-the-bowl dispensing device according to the first aspect of the invention. The method comprises attaching the dispensing device to a portion of a toilet bowl (TB) such that the device is within the interior of the toilet bowl and flushing the toilet to activate the dispensing device to release a first composition into the flush water and release a second composition into the toilet after the flush cycle is complete or nearly complete.

The use and operation of the ITB of the invention using the displacement method will now be described.

In the initial or pre-flush position, such as depicted in FIG. 2, neither the cleaning composition (2) nor the fragrance composition (4) is dispensed from the ITB into the toilet bowl (TB). The lever arm (16) is biased by spring (20) into an approximately horizontal orientation. The cleaning composition dosing cup (12) surrounds a portion of liquid flow chamber (21) including its exit and is in fluid communication with the bottle (1) containing the cleaning composition (2). The cleaning composition dosing cup (12) is partially filled with the cleaning composition (2) to a level where equilibrium is reached between the contents of the bottle containing the cleaning composition (1) and the atmospheric pressure on the surface of the cleaning composition in the dosing cup (2). The exit from liquid flow chamber (21) is submerged within the cleaning composition within the cleaning composition dosing cup (12). Factors affecting this equilibrium are gravity, the surface tension and viscosity of the cleaning composition (2), the geometry of liquid flow chamber (21) and the geometry of the cleaning composition dosing cup (12). Also considered is the distance from the bottom of the cleaning composition dosing cup (12) to the exit of the liquid flow chamber (21). That is, the volume of the cleaning composition dosing cup (12) not occupied by liquid flow chamber (21). The fragrance composition dosing cup (13) surrounds a portion of liquid flow chamber (22) including its exit and is in fluid communication with the bottle (3) containing the fragrance composition (4). The fragrance composition dosing cup (13) is partially filled with the fragrancing composition (4) to a level where equilibrium is reached between the contents of the bottle (3) containing the fragrance composition (4) and the atmospheric pressure on the surface of the fragrance composition in the dosing cup (13). Factors affecting this equilibrium are gravity, the surface tension and viscosity of the fragrancing composition (4), the geometry of liquid flow chamber (22), the geometry of the fragrance composition dosing cup (13), and the distance from the bottom of the fragrance composition dosing cup (13) to the exit of liquid flow chamber (22). That is, the volume of the fragrance composition dosing cup (13) not occupied by liquid flow chamber (22).

There is no discharge in the initial or pre-flush position from either the cleaning composition dosing cup (12) or the fragrancing composition dosing cup (13).

At the initiation of the second or flushing position, when a user flushes the toilet, a portion of the flush water (FW) comes into contact with the deflector ramp (23). The deflector ramp (23) is inclined downward towards the receptacle (18) and thus directs that portion of the flush water into the receptacle (18) disposed at one end of lever arm (16). This portion of the flush water is temporarily retained in the receptacle (18).

Figure 5A:
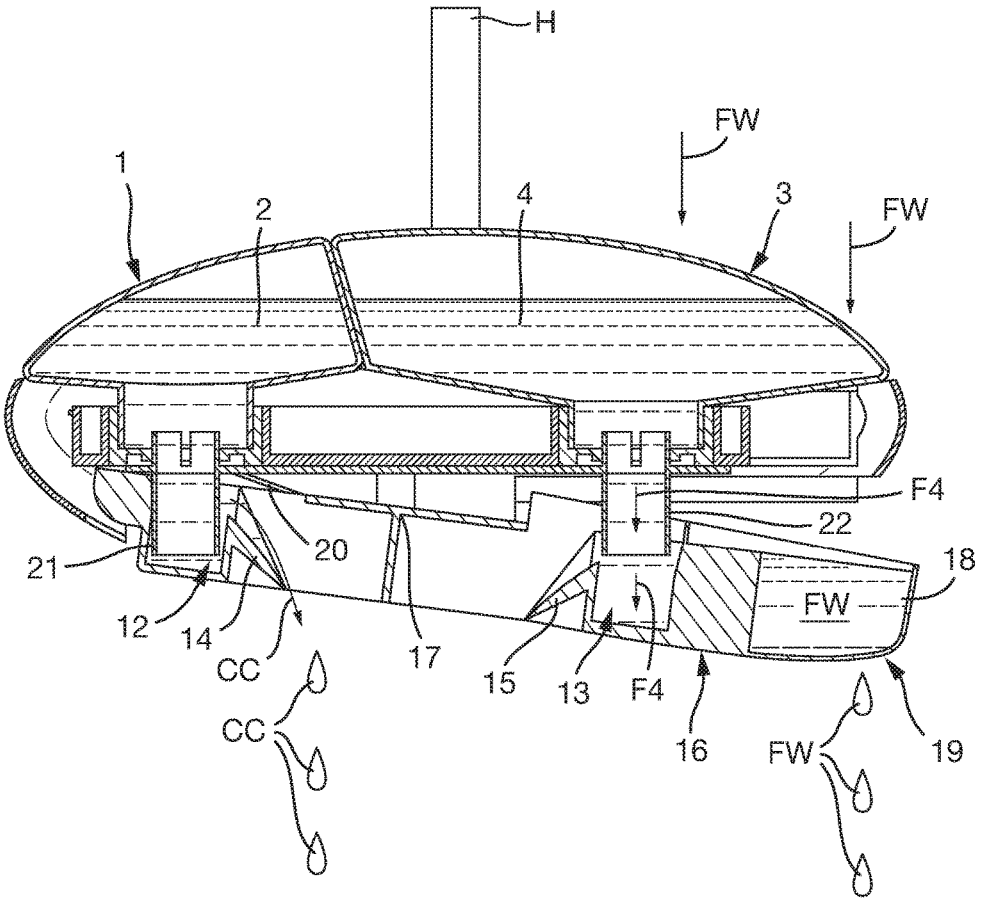
FIG. 5A is a cross-sectional view, taken along line A-A of FIG. 1, of the preferred embodiment of the ITB of the invention in its second or flushing position dosing a first composition to a toilet bowl.
Figure 5B:
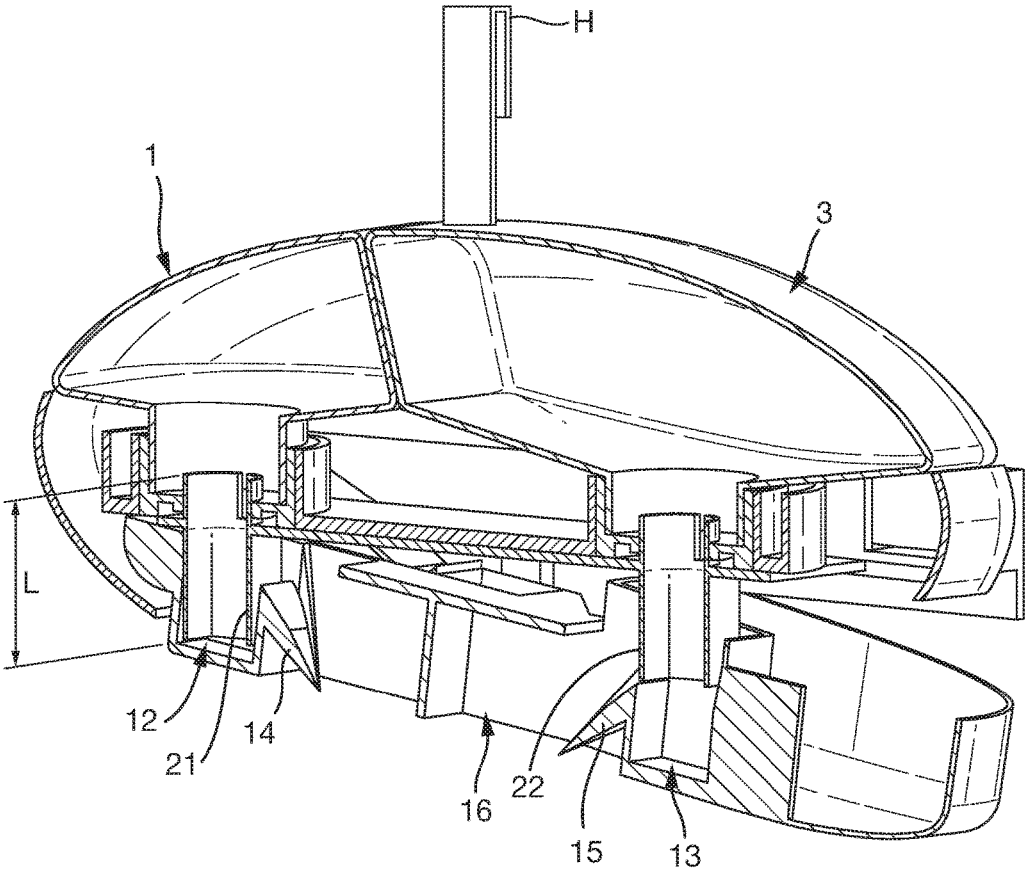
FIG. 5B is top perspective cross-sectional view, taken along line A-A of FIG. 1, of the ITB of the invention in its second or flushing position.

The weight of the retained flush water (FW), biases the lever arm (16) around the pivot point (17), against the force of the spring (20), such that the receptacle (18) moves downwards toward the bottom of the toilet bowl (TB). See FIG. 5A. This movement of the lever arm (16) positions the cleaning composition dosing cup (12), which resides on the lever arm (16) on the opposite side of the pivot point (17) from the receptacle (18), in an upwards direction towards the exit of the liquid flow chamber (21) associated with the bottle (1) containing the cleaning composition (2). As the cleaning composition dosing cup (12) is moved upward, the volume of the cleaning composition dosing cup (12) not occupied by liquid flow chamber (21) decreases such that a volume of the cleaning composition (2) is displaced from the cleaning composition dosing cup (12) via drip point (14). In a preferred embodiment, drip point (14) is in the form an inclined plane which forms a part of the sidewall of the cleaning composition dosing cup (12). The inclined plane is angled downward from the cleaning composition dosing cup (12) in a direction toward the bottom of the toilet bowl. The width of the inclined plane of drip point (14) is widest at the cleaning composition dosing cup (12) and narrows in width to a point at its distance furthest away from the cleaning composition dosing cup (12). See FIG. 5B. The geometry and surface area of drip point (14) cooperates with the surface tension and viscosity of the portion of cleaning composition displaced from the cleaning composition dosing cup (12) such that the displaced portion of the cleaning composition will flow downward along the inclined plane of drip point (14) to the narrow point of drip point (14) where it fall off of drip point (14) into the water in the toilet bowl (TB) during a flushing operation. Such is depicted in FIG. 5A as arrow "CC". In a preferred embodiment, the displaced dose of cleaning composition is about 0.1 ml, although the present invention is not restricted to such an amount. The entry of the displaced dose of cleaning composition into a toilet bowl during a flushing operation, combined with the action of the flush water, will provide a cleaning benefit to the toilet bowl.

This movement of the lever arm (16) around pivot point (17) simultaneously moves the fragrance composition dosing cup (13) downward and further away from the exit of liquid flow chamber (22) associated with the bottle (3) of fragrancing composition (4). By moving in this position, the volume of the fragrance composition dosing cup (13) not occupied by the fragrance composition flow chamber (22) increases and fluid communication between the fragrance composition dosing cup (13) and the liquid flow chamber (22) for the fragrance composition is temporarily disrupted. Air is thus permitted to enter the bottle (3) containing the fragrancing composition (4) and, as a result, an additional volume of fragrancing composition (4) can flow downward through the liquid flow chamber (22) and into the fragrance dosing cup (13). This continues until equilibrium is reached between the fragrance composition (4) in the fragrance composition bottle (3) and the fragrance composition in the fragrance dosing cup (13). There is no discharge in this position from the fragrance dosing cup (13).

The drainage hole (19) in the receptacle (18) is specifically sized to slowly release to the toilet that portion of the flush water that was retained in the receptacle (18). As the flush water retained in the receptacle (18) is slowly released back to the toilet bowl, the weight of the flush water in the receptacle (18) is reduced and removed from the lever arm (16). See for example FIG. 5A.

Figure 6:
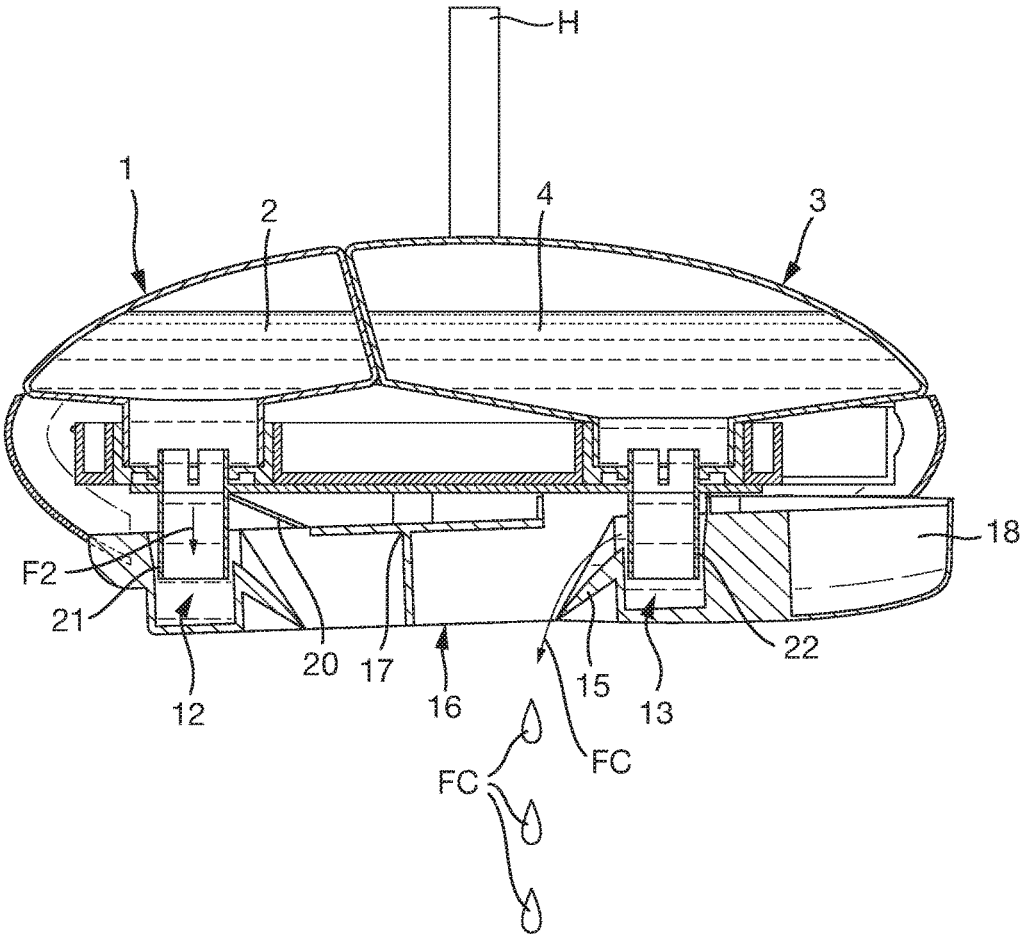
FIG. 6 is a cross-sectional view, taken along line A-A of FIG. 1, of the preferred embodiment of the ITB of the invention in its third or post-flush position dosing a second composition to a toilet bowl.

In the third or post-flush position, (see FIG. 6), when the weight of the flush water in the receptacle (18) has been sufficiently reduced, and preferably when all of the flush water in the receptacle has been released, the lever arm (19) is biased by the spring (20) around the pivot point (17) in a manner such that the cleaning composition dosing cup (12) is moved downwards and back to its initial or pre-flush position. Due to this movement, the volume of the cleaning composition dosing cup (12) not occupied by the liquid composition flow chamber (21) increases and fluid communication between the cleaning composition dosing cup (12) and the liquid flow chamber for the cleaning composition (21) is temporarily disrupted. Air is thus permitted to enter the bottle (1) of cleaning composition (2) and, as a result, cleaning composition (2) flows downward through liquid flow chamber (21) and into the cleaning composition dosing cup (12) until equilibrium is reached. There is no discharge from the cleaning composition dosing cup (12) during this re-filling operation.

Simultaneously, this movement of lever arm (16) moves the fragrance composition dosing cup (13) which has been filled with the fragrancing composition (4) upwards toward the opening of the liquid flow chamber (22) associated with the bottle (3) containing the fragrancing composition (4). As the fragrance composition dosing cup (13) is moved upwards, the volume of the fragrance composition dosing cup (13) not occupied by liquid dosing chamber (22) decreases such that a volume of the fragrancing composition (4) is displaced from the fragrance dosing cup (13) via a drip point (15) (See FIG. 6). In a preferred embodiment, drip point (15) is in the form an inclined plane which forms a part of the sidewall of the fragrancing composition dosing cup (13). The inclined plane is angled downward from the fragrancing composition dosing cup (13) a direction toward the bottom of the toilet bowl. The width of the inclined plane of drip point (15) is widest at the fragrancing composition dosing cup (13) and narrows in width to a point at its distance furthest away from the fragrancing composition dosing cup (13). The geometry and surface area of drip point (15) cooperates with the surface tension and viscosity of the portion of fragrance composition displaced from the fragrance composition dosing cup (13) such that the displaced portion of the fragrance composition will drip from drip point (15) into the water in the toilet bowl (TB) near the end of or after the flushing operation is completed. Such is depicted on FIG. 6 as arrow "FC". In a preferred embodiment, the displaced dose of fragrance composition is about 0.2 ml, although the present invention is not restricted to such an amount. In this manner, the entry of the displaced dose of fragrance composition into a toilet bowl is delayed until near the end of of after the flushing operation has been completed. Due to its essential oil characteristics and the fact that the flushing operation of the toilet bowl has ceased, the displaced dose of fragrance composition is able to spread across and float on the top of the water remaining in the toilet bowl to create a barrier. When a subsequent user defecates into the toilet bowl, malodors associated with the feces are trapped beneath the essential oil barrier, thus eliminating or reducing the amount of malodor emitted from the feces into the air within the bathroom. Thus the essential oil barrier provides both a malodor reduction and fragrancing benefit.

It has been observed that the ratio of the cross-sectional area "A" of the liquid flow chambers (21, 22), calculated according to their internal diameter, to their length "L" (see FIG. 5B) plays an important role in delivering a measured dose of the cleaning composition (2) and the fragrancing composition (4) to the toilet bowl. As long as the ratio A:L is at least about 2.5:1, but preferably at least about 3.5:1, doses of the cleaning composition (2) and the fragrancing composition (4) will be delivered to the toilet bowl in the manner herein described.

Pipe Dose Method

According to a third aspect (the "pipe dose method") of the invention there is provided a dispensing device for using a flow of water during a toilet flush to dispense two liquid compositions into a toilet bowl at two separate time intervals, the device comprising:

a first bottle for holding a first composition, the bottle having a mouth and a closure for covering the mouth;

a second bottle for holding a second composition, the second bottle having a mouth and a closure for covering the mouth;

a supporting cage for holding the first and second bottles in an inverted position, the supporting cage having piercing structures and liquid flow chambers suitable for opening the closures of the first and second bottles and conveying the first composition to a first collar and the second composition to a second collar;

a lever arm pivotably connected to the supporting cage by a pivot point; the lever arm comprising:

the first collar and the second collar, the first and second collars being disposed on the lever arm on opposite sides of the pivot point; and optionally, but preferably, a receptacle for temporarily retaining a portion of the flow of water during a toilet flush;

a biasing means in contact with the lever arm and the supporting cage;

a suspension means for suspending the supporting cage from a rim of the toilet bowl to position the supporting cage within the flow of water during a toilet flush such that at least a portion of the flow of water is directed into the receptacle during a toilet flush;

wherein at the start of or during the toilet flush, the water retained in the receptacle causes the lever arm to rotate from its initial position about the pivot point and cause the first composition to be dispensed from the first collar into the toilet bowl; and near or at the end of the toilet flush, the lever arm is biased about the pivot point by the biasing means to its initial position and cause the second composition to be dispensed from the second collar into the toilet bowl, such that the second composition remains in the toilet bowl after the flush is complete.

By "collar" it is meant a structure similar to that of an open pipe. That is, the structure is hollow throughout its length, open at its two opposed ends, and can serve as a conduit for a fluid. The cross-sectional geometry of the collar is preferably round, like a circular pipe; however, it can be of other cross-sectional geometries (e.g., oval, square, rectangular) as well.

In its third aspect, the ITB of the present invention preferably comprises two separate containers or bottles (301, 303), although a single dual chamber bottle may also be used. One bottle (301) contains a cleaning composition (302) and the second bottle (303) contains a fragrance composition (304). In further embodiments other compositions may be used such as, for example but not limited to, those containing bleach, hydrogen peroxide, quaternary ammonium compounds and other actives effective against microorganisms typically found in a toilet bowl environment.

Figure 7:
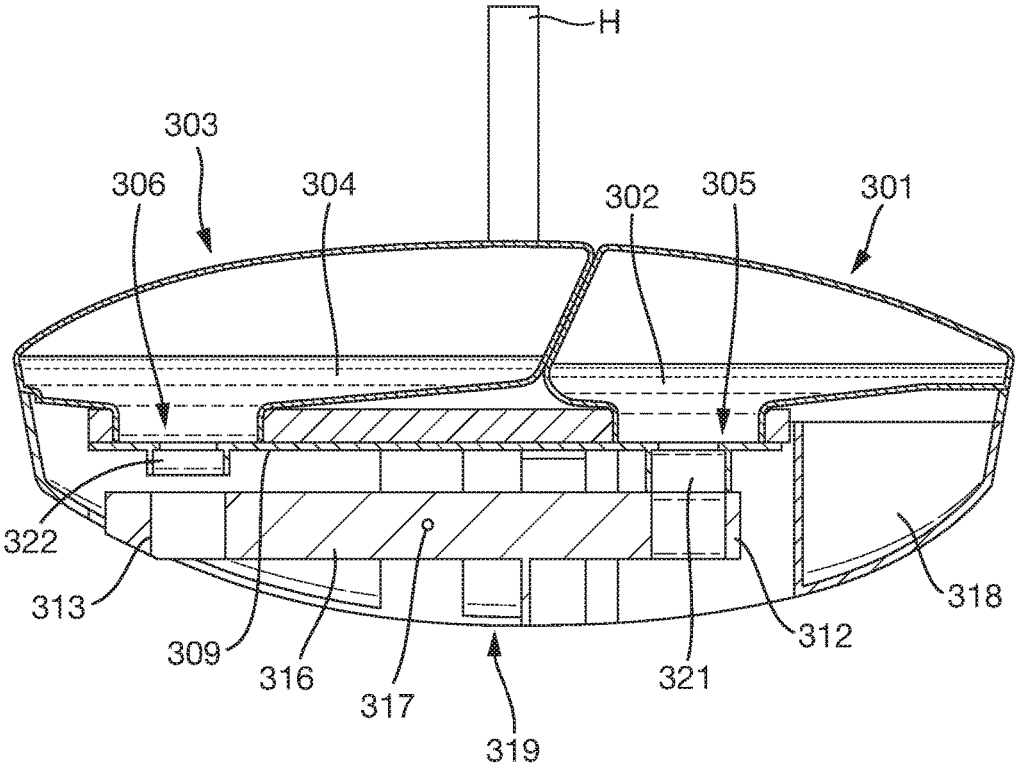
FIG. 7 is a cross-sectional view taken along line A-A of FIG. 1, of a second embodiment of the ITB of the invention in its initial pre-flush position.

As best observed in FIG. 7, each bottle (301, 303) has a mouth (305, 306) and a bottle closure (not shown) enclosing the bottles to retain the cleaning composition (302) and the fragrance composition (304), respectively. The bottles (301, 303) are inverted with their mouths (305, 306) facing the bottom of the toilet bowl and inserted by a user into a supporting cage (309). Associated with the supporting cage (309) are two piercing structures (not shown) and liquid flow chambers (321, 322). As the user applies force to the bottles (301, 303) to insert them into the supporting cage (309), the bottle closure covering the mouth (305) of the bottle (301) containing the cleaning composition (302) is aligned with and breached by the piercing structure (310) associated with the flow chamber (321). With the bottle (301) of cleaning composition (302) thus open to atmospheric pressure, the cleaning composition (302) due to its surface tension and gravity is able to flow downward through liquid flow chamber (321) and fill collar (312) which in the initial or start position of the ITB abuts the exit of liquid flow chamber (321). Due to a careful balancing of atmospheric pressure, surface tension of the cleaning composition (302), and geometries of the collar (312) and liquid flow chamber (321), there is no discharge of the cleaning composition (302) from the collar (312) in this initial or pre-flush position.

In a similar manner, as the user applies force to the bottle (303) containing the fragrance composition (304), the bottle closure covering the mouth (306) of the bottle (303) is breached by a second piercing structure which is associated the flow chamber (322). With the bottle (303) of fragrance composition (304) thus open to atmospheric pressure, the fragrance composition (304) due to its surface tension and gravity is able to flow downward into liquid flow chamber (322). In this initial or pre-flush position, collar (313) is distanced from the exit of liquid flow chamber (322) and no fragrance composition (304) enters the collar (313). Due to a careful balancing of atmospheric pressure, surface tension of the fragrancing composition (304) and geometry of the liquid flow chamber (322) there is no discharge of the fragrancing composition (304) from the exit of the liquid flow chamber (322) in this initial or pre-flush position.

The first collar (312) and the second collar (313), hereinafter for the sake of clarity referred to respectively as the cleaning composition collar (312) and the fragrance composition collar (313), are disposed on a lever arm (316) which is attached to the supporting cage (319) by means of a pivot point (317). The lever arm (316) is able to be pivoted around the pivot point (317). The cleaning composition collar (312) and the fragrance composition collar (313) are disposed on opposite sides of the pivot point (317). The lever arm (316) is constructed to include an inclined deflector ramp (323). When the ITB is properly positioned inside of a toilet bowl, the deflector ramp (323) abuts or is in close proximity to a wall of the toilet bowl. Further disposed on the lever arm (316) is a receptacle (318) at an end of and in fluid communication with the deflector ramp (323). The receptacle (318) is proximate to and on the same side of the pivot point (317) as the cleaning composition collar (312). The receptacle (318) contains at its lowermost point one or more drainage holes (319). Disposed between and in contact with the lever arm (316) and the supporting cage (319) is a biasing means such as a spring (320). The spring is proximate to and on the same side of the pivot point (317) as the fragrance composition collar (313). The spring (320) is designed so as to initially orient the lever arm (316) in a position such that the cleaning composition collar (312) abuts the exit of liquid flow chamber (321) and the fragrance composition collar (313) is displaced or distanced from the exit of liquid flow chamber (322). As hereinabove described, in this initial or pre-flush orientation, the cleaning composition collar (312) is filled with cleaning composition (302) and the fragrance composition collar (313) is not filled with the fragrance composition (304).

Pipe Dose Method Use

According to a fourth aspect of the invention there is provided a method of use of an in-the-bowl dispensing device according to the third aspect of the invention. The method comprises attaching the dispensing device to a portion of a toilet bowl (TB) such that the device is within the interior of a toilet bowl (TB), and flushing the toilet to activate the dispensing device to relase a first composition into the flush water and release a second composition into the toilet bowl after the flush cycle is complete or nearly complete.

The use and operation of the third aspect of the invention using the pipe dose method will now be described.

In the initial or pre-flush position, such as depicted in FIG. 7, neither the cleaning composition (302) nor the fragrance composition (304) is dispensed from the ITB into the toilet bowl. The cleaning composition collar (312) abuts the exit of liquid flow chamber (321) and is in fluid communication with the bottle (301) containing the cleaning composition (302). The cleaning composition collar (312) is filled with the cleaning composition. Equilibrium exists between the contents of the bottle containing the cleaning composition (301) and atmospheric pressure. Factors influencing this equilibrium are gravity, the surface tension and viscosity of the cleaning composition (302), the geometry of liquid flow chamber (321) and the geometry of the cleaning composition collar (312). The fragrance composition collar (313) is distanced from liquid flow chamber (322) including its exit.

Figure 8:
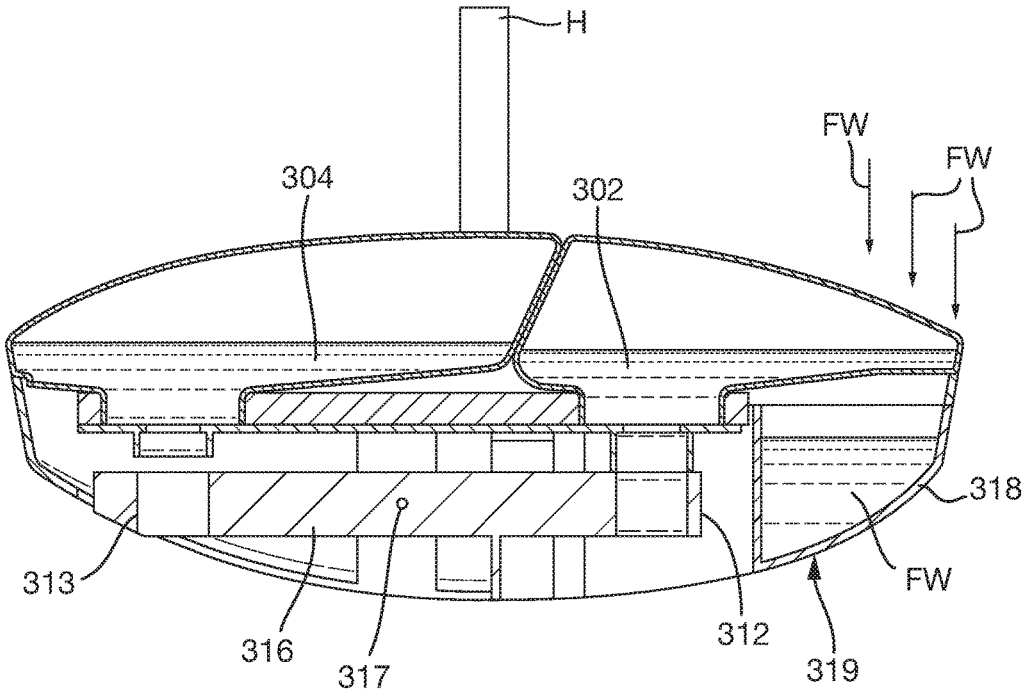
FIG. 8 is a cross-sectional view, taken along A-A of FIG. 1, of a second embodiment of the ITB of the invention in its position when a user has activated a toilet flush.

At the initiation of the second or flushing position, when a user flushes the toilet, a portion of the flush water (FW) comes into contact with the deflector ramp (323). The deflector ramp (323) is inclined downward towards receptacle (318) and thus directs that portion of the flush water into the receptacle (318) disposed at one end of lever arm (316). This portion of the flush water is temporarily retained in the receptacle (318). See FIG. 8.

Figure 9:
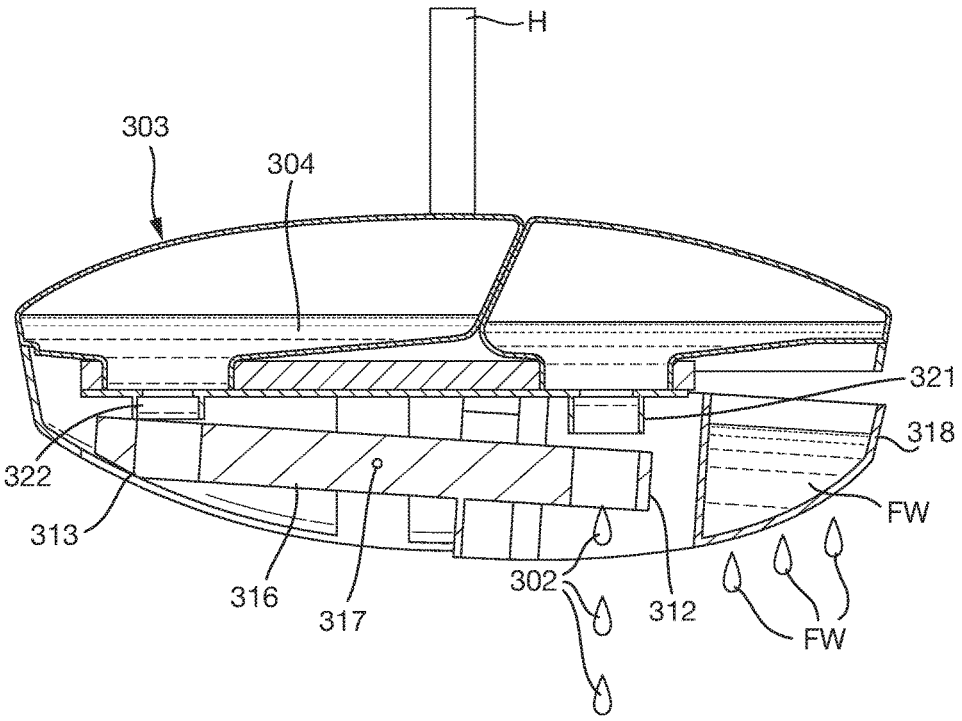
FIG. 9 is a cross-sectional view, taken along A-A of FIG. 1, of a second embodiment of the ITB of the invention in its second or flushing position dosing a first composition to a toilet bowl.

The weight of the retained flush water (FW) biases the lever arm (316) around the pivot point (317), against the force of the spring (320), such that the receptacle (318) moves downward towards the bottom of the toilet bowl. See FIG. 9. This movement of the lever arm (316) moves the cleaning composition collar (312) away from the exit of the liquid flow chamber (321). Once the cleaning composition collar (312) no longer abuts the exit of liquid flow chamber (321), atmospheric pressure presses downward on the cleaning composition within the cleaning composition collar (312) and cleaning composition (302) is released from the cleaning composition collar (312) into the toilet bowl. The dose of cleaning composition released into the toilet bowl is preferably about 0.1 ml. This action is similar to what occurs when a drinking straw is placed in a glass of liquid and a user places a finger over the end of the drinking straw not within the glass. Keeping his finger in-place, the user is able to withdraw the straw vertically from the glass of liquid and liquid is retained within the straw. The upwards force of air pressure on the liquid in the straw through the open end of the straw is stronger than the force of gravity pulling down on the liquid. Therefore the liquid remains suspended in the straw. However, once the user lifts his finger from the end of the straw, the liquid within the straw exits the opposite end of the straw. This occurs because the downward force of the air pressure on the liquid will now be the same as the upward force. These two effects cancel each other out, leaving gravity as the dominant force causing the suspended liquid in the straw to drop out the bottom of the straw.

The movement of the lever arm (316) around pivot point (317) simultaneously moves the fragrance composition collar (313) upward toward liquid flow chamber (322) until the fragrance composition collar (313) is an abutting relationship with liquid flow chamber (322). In this position, a portion of the fragrance composition (304) moves downward and out from bottle (303), through the liquid flow chamber (322), and fills fragrance composition collar (313). This continues until equilibrium is reached between the fragrance composition (304) in the fragrance composition bottle (303) and the fragrance composition in the fragrance composition collar (313). There is no discharge in this position from the fragrance composition collar (313).

The drainage hole (319) in the receptacle (318) is specifically sized to slowly release to the toilet that portion of the flush water that was retained in the receptacle (318). As the flush water retained in the receptacle (318) is slowly released back to the toilet bowl, the weight of the flush water in receptacle (318) is reduced and removed from the lever arm. See FIG. 9.

Figure 10:
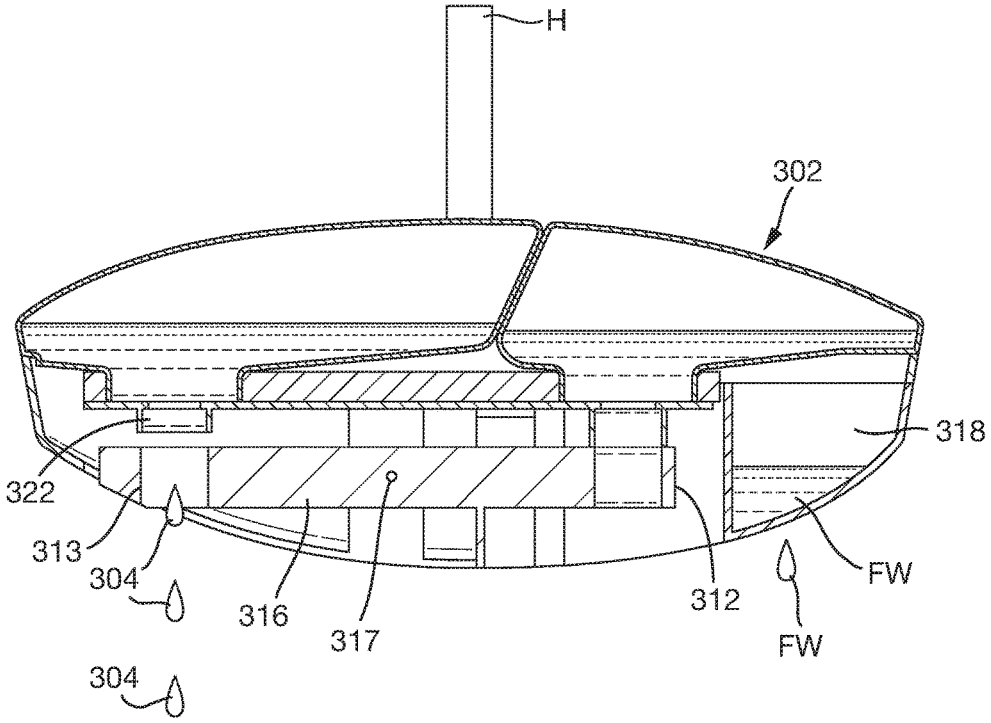
FIG. 10 is a cross-sectional view, taken along A-A of FIG. 1, of a second embodiment of the ITB of the invention in its third or post-flush position dosing a second composition to a toilet bowl.

In the third or post-flush position (see FIG. 10), when the weight of the flush water in the receptacle (318) has been sufficiently reduced, and preferably when all of the flush water in the receptacle (318) has been released, the lever arm (316) is biased by the spring (320) around the pivot point (317) in a manner such that the cleaning composition collar (312) is moved upwards and back to its pre-flush position abutting the exit of liquid flow chamber (321). In this position, cleaning composition again flows downward from bottle (302), through liquid flow chamber (321) and refills the cleaning composition collar (312). This movement of the lever arm (316) moves the fragrance composition collar (313) away from the exit of the liquid flow chamber (322). Once the fragrance composition collar (313) no longer abuts the exit of liquid flow chamber (322), atmospheric pressure presses downward on the fragrance composition within the fragrance composition collar (313) and fragrance composition (304) is released from the fragrance composition collar (313) into the toilet bowl. In this manner, a dose of the fragrance composition (304) into the toilet bowl is delayed until near the end of or after the flushing operation has been completed. Due to its essential oil characteristics and the fact that the flushing operation of the toilet has ceased, the dose of fragrance composition residing in the toilet bowl is able to provide both a malodor reduction and fragrancing benefit. Preferably, the dose of fragrance composition released to the toilet bowl is about 0.2 ml.

Figure 11:
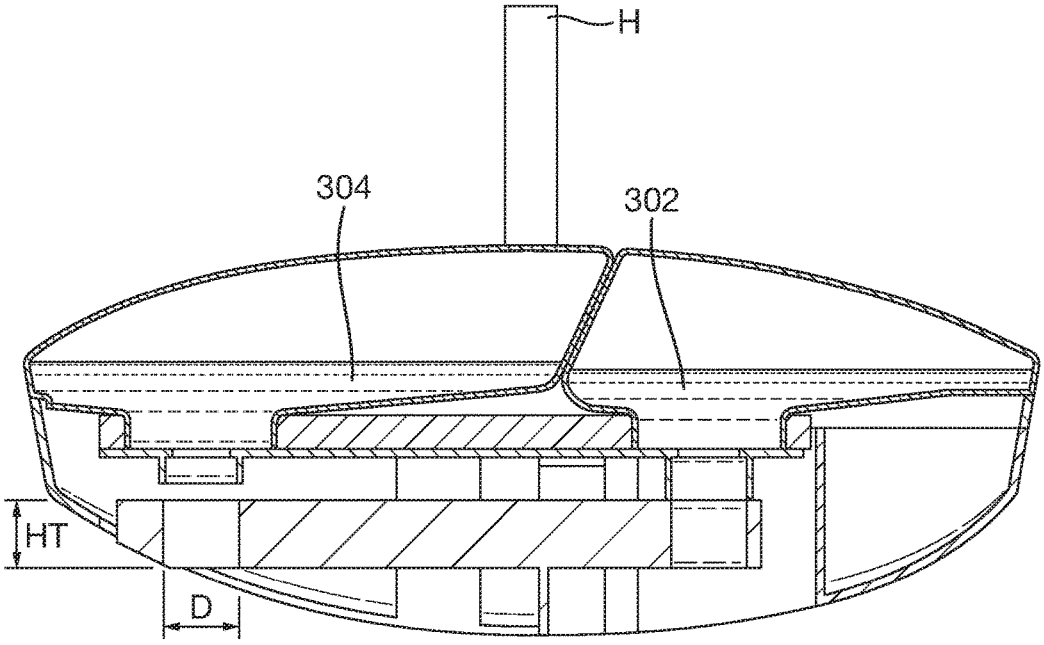
FIG. 11 is a cross-sectional view, taken along A-A of FIG. 1, of a second embodiment of the ITB of the invention in its third or post-flush position after the second composition has been dosed to a toilet bowl.

In its now finished position (FIG. 11), the ITB is ready to again to discharge a dose of cleaning composition to the toilet bowl during the next toilet flushing operation.

It has been observed that the ratio of the cross-sectional area "A" of the liquid flow chambers (321, 322), calculated according to their internal diameter, to their length "L" plays an important role in delivering a measured dose of the cleaning composition (302) and the fragrancing composition (304) to the toilet bowl. The same has been observed in relation to the cleaning composition collar (312) and fragrancing composition collar (313). As long as the ratio of the height "HT" (see FIG. 11) to the internal diameter "D" (H:D) is at least about 1.5, but preferably at least about 1.6, doses of the cleaning composition (302) and the fragrancing composition (304) will be delivered to the toilet bowl in the manner herein described.

Although the principles of operation of the ITB of the invention as herein described may be used to release two liquid compositions into a toilet bowl at different time intervals, in a preferred embodiment a cleaning composition is released into the toilet bowl during a flushing operation of the toilet while a fragrance composition is released to the toilet bowl in a delayed manner near the end of or after the flushing operation has ceased, such that the fragrance composition is retained within the toilet bowl until the next flushing operation is initiated. It was observed that the entry of a dose of cleaning composition into the toilet bowl during a flushing operation, via either the displacement method or the pipe dose method, combined with the turbulence of the flush water, provided a cleaning and foaming benefit to the toilet bowl. It was also observed that when the cleaning composition was dosed between the beginning and middle of the toilet flush, most of the surfactant in the cleaning composition was flushed out of the toilet bowl. Thus, the foam riding on the surface of the water in the bowl was the only source of surfactant remaining in the toilet bowl after the flush was complete. The surfactants, being surface active agents, would spread across the water surface until they coated all water interfaces. This would result in surfactant being removed from the foam until there was not sufficient surfactant remaining in the foam to support the foam. Thus the foam would "break". To overcome this problem, so that a sufficient volume of foam would remain in the bowl after the flush was complete (a desirable consumer benefit), it was observed that the nearer to the end of the flush the cleaning composition was introduced to the toilet bowl, the longer the foam would last as in that instance a sufficient amount of surfactant remained in the bowl to be able to still spread to all interfaces but also still be able to support the foam so it would not "break".

Numerous characteristics and advantages have been set forth in the foregoing description, together with details of structure and function. While the invention has been disclosed in several forms, it will be apparent to those skilled in the art that many modifications, additions, and deletions, especially in matters of liquid compositions, as well as shape, size and arrangement of parts, can be made therein without departing from the spirit and scope of the invention and its equivalents as set forth in the following claims. Therefore, other modifications or embodiments as may be suggested by the teachings herein are particularly reserved as they fall within the breadth and scope of the claims here appended.

What is claimed is:

1. A device which operates to dispense two compositions into a toilet bowl at different time intervals, the device comprising:

a first container containing a first composition;

a second container containing a second composition;

a supporting cage supporting the first and second containers, the supporting cage having a means for conveying the first composition to a first dosing cup and the second composition to a second dosing cup;

a lever arm pivotably connected to the supporting cage by a pivot point; the lever arm comprising:

the first dosing cup and the second dosing cup, the first and second dosing cups being disposed on the lever arm on opposite sides of the pivot point; and a receptacle for temporarily retaining a portion of the flow of water during a toilet flush;

a biasing means in contact with the lever arm;

a suspension means for suspending the supporting cage from a portion of the toilet bowl to position the supporting cage within the flow of water during a toilet flush such that at least a portion of the flow of water is directed into the receptacle during a toilet flush;

wherein, during operation, at the start of or during the toilet flush, the water retained in the receptacle causes the lever arm to rotate from its initial position about the pivot point and cause the first composition to be dispensed from the first dosing cup into the toilet bowl; and near or at the end of the toilet flush, the lever arm is biased about the pivot point by the biasing means to its initial position and causes the second composition to be dispensed from the second dosing cup into the toilet bowl.

2. The device of claim 1 wherein the first composition provides a cleaning benefit to the toilet bowl.

3. The device of claim 1 wherein the second composition provides a fragrancing benefit.

4. The device of claim 1 wherein the biasing means is a spring.

5. The device of claim 1 wherein the means for conveying are liquid flow chambers.

6. The device of claim 5 wherein the liquid flow chambers further comprise a piercing structure.

7. The device of claim 5 wherein the ratio of the cross-sectional area of a liquid flow chamber to its length is at least about 2.5:1.

8. The device of claim 1 wherein at least one of the first and second containers are inverted.

9. The device of claim 1 wherein at least one of the first and second dosing cups further comprises a drip point.

10. The device of claim 1 wherein the receptacle comprises one or more drainage holes.

11. The device of claim 1 wherein said lever arm further comprises a deflector ramp.

12. A device which operates to dispense two compositions into a toilet bowl at different time intervals, the device comprising:

a first container containing a first composition;

a second container containing a second composition;

a supporting cage supporting the first and second containers, the supporting cage having a means for conveying first composition to a first collar and the second composition to a second collar;

a lever arm pivotably connected to the supporting cage by a pivot point; the lever arm comprising:

the first collar and the second collar, the first and second collars being disposed on the lever arm on opposite sides of the pivot point; and a receptacle for temporarily retaining a portion of the flow of water during a toilet flush;

a biasing means in contact with the lever arm;

a suspension means for suspending the supporting cage from a portion of the toilet bowl to position the supporting cage within the flow of water during a toilet flush such that at least a portion of the flow of water is directed into the receptacle during a toilet flush;

wherein, during operation, at the start of or during the toilet flush, the water retained in the receptacle causes the lever arm to rotate from its initial position about the pivot point and cause the first composition to be dispensed from the first collar into the toilet bowl; and near or at the end of the toilet flush, the lever arm is biased about the pivot point by the biasing means to its initial position and causes the second composition to be dispensed from the second collar into the toilet bowl, such that the second composition remains in the toilet bowl.

* * * * *